US005692244A

United States Patent [19]

Johnson et al.

[11] Patent Number: 5,692,244

[45] Date of Patent: Dec. 2, 1997

[54] CAP WITH ABSORBENT LINER

[76] Inventors: Anthonio Maurice Johnson; Tuyet Johnson, both of 1238 Dunsworth, Wichita, Kans. 67212

[21] Appl. No.: 620,154

[22] Filed: Mar. 22, 1996

[51] Int. Cl.[6] ..... A42B 1/06

[52] U.S. Cl. ..... 2/181; 2/195.1; 2/195.2

[58] Field of Search ..... 2/171, 171.1, 174, 2/175.1, 181, 195.1, 195.2, 200.1, 181.2, 181.4

[56] References Cited

U.S. PATENT DOCUMENTS

| | | | |
|---|---|---|---|
| D. 266,370 | 10/1982 | Boden . | |
| D. 281,031 | 10/1985 | Gilligan . | |
| D. 314,271 | 2/1991 | Huegy . | |
| D. 352,379 | 11/1994 | Pierce, Jr. . | |
| 5,365,613 | 11/1994 | Henegan | 2/174 |
| 5,384,916 | 1/1995 | Portney . | |
| 5,548,845 | 8/1996 | Gallup | 2/195.2 |

FOREIGN PATENT DOCUMENTS

| | | | |
|---|---|---|---|
| 15993 | of 1912 | United Kingdom | 2/195.1 |

*Primary Examiner*—Diana Biefeld

[57] ABSTRACT

A head covering includes a cap-like assembly made from soft, water absorbent fabric which may be characterized by having loops. The soft, water absorbent fabric may be comprised of terry cloth, and the terry cloth fabric may be comprised of plural terry cloth panels sewn together by stitches. A visor is connected to the cap-like assembly. In one embodiment, the cap-like assembly includes a head-size adjustment strap located in a back portion of the cap-like assembly. The head-size adjustment strap includes a portion of hook-containing material that attaches to the cap-like assembly for securing a selected head-size adjustment. In another embodiment, the cap-like assembly serves as an inner cap-like assembly, and an inner visor is connected to the inner cap-like assembly. An inner connector assembly is connected to a top side of the inner visor. An outer cap-like assembly. An outer visor is connected to the outer cap-like assembly. An outer connector assembly is connected to a bottom side of the outer visor. The inner connector assembly and the outer connector assembly are placed in registration when the outer cap-like assembly covers the inner cap-like assembly and when the outer visor covers the inner visor. The inner connector assembly and the outer connector assembly are complementary snap connectors. The outer visor is longer than the inner visor. The outer cap-like assembly is larger than the inner cap-like assembly.

9 Claims, 2 Drawing Sheets

FIG 3
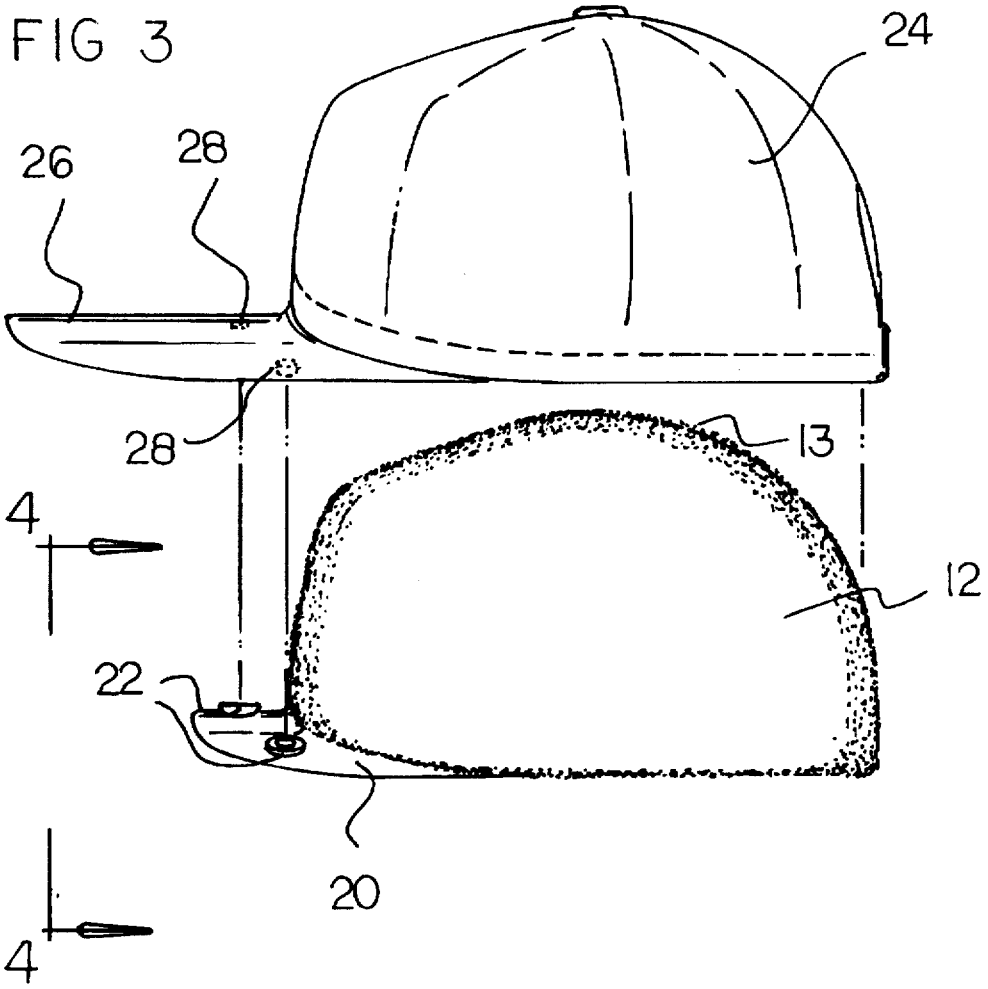
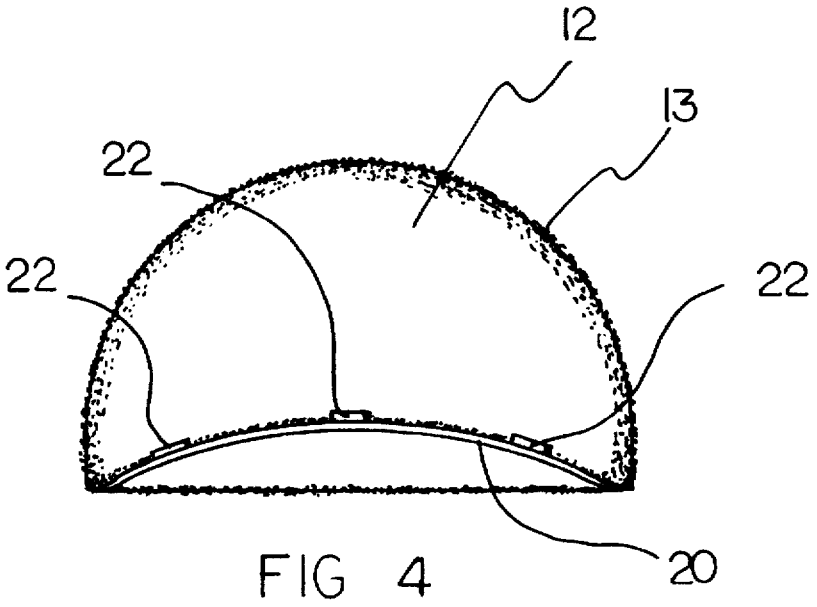
FIG 4

CAP WITH ABSORBENT LINER

BACKGROUND OF THE INVENTION

1. Field of the Invention

The present invention relates generally to headwear and, more particularly, to headwear especially adapted for covering a head in hot weather.

2. Description of the Prior Art

When the weather is hot and when sunlight is intense, a person often wears headwear to protect one's head from the sun's rays. Often the headwear includes a head-covering portion and a visor for shielding one's eyes and face. In some head-covering portions, vent holes are provided to aid in air circulation for cooling the person's head. Yet, headwear does not generally employ any cooling medium, other than ambient air, to aid in cooling a person's head. Depending upon specific ambient conditions, ambient air may not circulate well and may not have good heat exchange properties. In this respect, it would be desirable if headwear were provided that has a cooling medium, other than ambient air, to aid in cooling a person's head.

Headwear is often designed to protect a person's head from rain. Consequently, such headwear is made from materials that are substantially water repellent. If a person wearing such water repellent headwear wants to gain the benefit of the cooling properties of water, such as from rain, the person must take the headwear off. To avoid encumbering the person with the need to hand carry headwear in rain, it would be desirable if headwear were provided which can remain on a person's head and still employ the cooling properties of water.

There are some forms of headwear that have generally water-repellent head covering portions but that also have special portions of water absorbent material for absorbing perspiration from a person's forehead. Such water absorbent material is usually present in the form of a head band. Head bands are also known that are independent of head coverings. Such independent head bands generally cover a person's forehead. Yet, such water absorbent materials that are found in a head band are not found in a head-covering portion of headwear.

Headwear that has a water repellent head-covering portion is not washable in an aqueous medium in a washing machine. Exposure to such washing machine conditions could destroy the water repellency of the headwear. However, for sanitary purposes, it would be desirable if headwear could be washed in an aqueous medium in a washing machine. Moreover, it would be desirable if such machine washing would not destroy important properties of the headwear.

In hot weather, especially when a person is physically active, a person may perspire to such an extent that it would be desirable to blot or wipe perspiration with a water absorbent towel. However, such a water absorbent towel may not be readily available. In this respect, it would be desirable if headwear were provided which could serve the function of a water absorbent towel for blotting or wiping perspiration.

Throughout the years, a number of innovations have been developed relating to headwear, and the following U.S. patents are representative of some of those innovations: U.S. Pat. No. 5,384,916, Des. Pat. No. 266,370, Des. Pat. No. 281,031, Des. Pat. No. 314,271, and Des. Pat. No. 352,379. It is noted, however, that none of the cited patents discloses that headwear is provided which has a water-absorbent material used for the head-covering portion of the headwear.

Still other features would be desirable in an item of headwear. For example, a well known, water absorbent, and machine washable material is terry cloth. Terry cloth is often used to make water absorbent and machine washable towels. In this respect, it would be desirable if headwear were provided which employs terry cloth as a material for the head-covering portion of headwear.

Terry cloth is defined as a soft absorbent, usually cotton, fabric characterized by loops in all over or pattern effects on one or both sides and made in various weights as for towels, bathrobes, sportswear, and spreads. Generally speaking, it would be desirable if headwear were provided which has a head-covering portion comprised of a soft, water absorbent fabric characterized by having loops. Even more generally, it would be desirable if headwear were provided which has a head-covering portion comprised of a soft, water absorbent fabric.

Thus, while the foregoing body of prior art indicates it to be well known to use headwear having vent holes to provide cooling under the headwear, the prior art described above does not teach or suggest a head covering which has the following combination of desirable features: (1) has a cooling medium, other than ambient air, to aid in cooling a person's head; (2) can remain on a person's head and still employ the cooling properties of water; (3) employs water absorbent materials that are found in a head band; (4) can be washed in an aqueous medium in a washing machine without destroying important properties of the head covering; (5) can serve as a water absorbent towel for blotting or wiping perspiration; (6) employs terry cloth as a material for the head covering; (7) is comprised of a soft, water absorbent fabric characterized by having loops; and (8) is comprised of a soft, water absorbent fabric. The foregoing desired characteristics are provided by the unique head covering of the present invention as will be made apparent from the following description thereof. Other advantages of the present invention over the prior art also will be rendered evident.

SUMMARY OF THE INVENTION

To achieve the foregoing and other advantages, the present invention, briefly described, provides a head covering which includes a cap-like assembly made from soft, water absorbent fabric. The soft, water absorbent fabric is characterized by having loops. The soft, water absorbent fabric may be comprised of terry cloth. The terry cloth fabric may be comprised of plural terry cloth panels sewn together by stitches. A visor is connected to the cap-like assembly. In one embodiment, the cap-like assembly includes a head-size adjustment strap located in a back portion of the cap-like assembly. The head-size adjustment strap includes a portion of hook-containing material that attaches to the cap-like assembly for securing a selected head-size adjustment.

In another embodiment, the cap-like assembly serves as an inner cap-like assembly, and an inner visor is connected to the inner cap-like assembly. An inner connector assembly is connected to a top side of the inner visor. An outer cap-like assembly. An outer visor is connected to the outer cap-like assembly. An outer connector assembly is connected to a bottom side of the outer visor. The inner connector assembly and the outer connector assembly are placed in registration when the outer cap-like assembly covers the inner cap-like assembly and when the outer visor covers the inner visor. The inner connector assembly and the outer connector assembly are complementary snap connectors. The outer visor is longer than the inner visor. The outer cap-like assembly is larger than the inner cap-like assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved head covering which has all of the advantages of the prior art and none of the disadvantages.

It is another object of the present invention to provide a new and improved head covering which may be easily and efficiently manufactured and marketed.

It is a further object of the present invention to provide a new and improved head covering which is of durable and reliable construction.

An even further object of the present invention is to provide a new and improved head covering which is susceptible of a low cost of manufacture with regard to both materials and labor, and which accordingly is then susceptible of low prices of sale to the consuming public, thereby making such a head covering available to the buying public.

Still yet a further object of the present invention is to provide a new and improved head covering which has a cooling medium, other than ambient air, to aid in cooling a person's head.

Still another object of the present invention is to provide a new and improved head covering that can remain on a person's head and still employ the cooling properties of water.

Yet another object of the present invention is to provide a new and improved head covering which employs water absorbent materials that are found in a head band.

Even another object of the present invention is to provide a new and improved head covering that can be washed in an aqueous medium in a washing machine without destroying important properties of the head covering.

Still a further object of the present invention is to provide a new and improved head covering which can serve as a water absorbent towel for blotting or wiping perspiration.

Yet another object of the present invention is to provide a new and improved head covering that employs terry cloth as a material for the head covering.

Still another object of the present invention is to provide a new and improved head covering which is comprised of a soft, water absorbent fabric characterized by having loops.

Yet another object of the present invention is to provide a new and improved head covering that is comprised of a soft, water absorbent fabric.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an exploded perspective view of a second embodiment of the head covering of the invention that has its own visor portion and that fits under a cap which has a visor.

FIG. 4 is a front view of the second embodiment of the invention taken along line 4—4 of FIG. 3 and removed from the cap.

DESCRIPTION OF THE PREFERRED EMBODIMENT

With reference to the drawings, two embodiments of a new and improved head covering embodying the principles and concepts of the present invention will be described.

Figure 1:
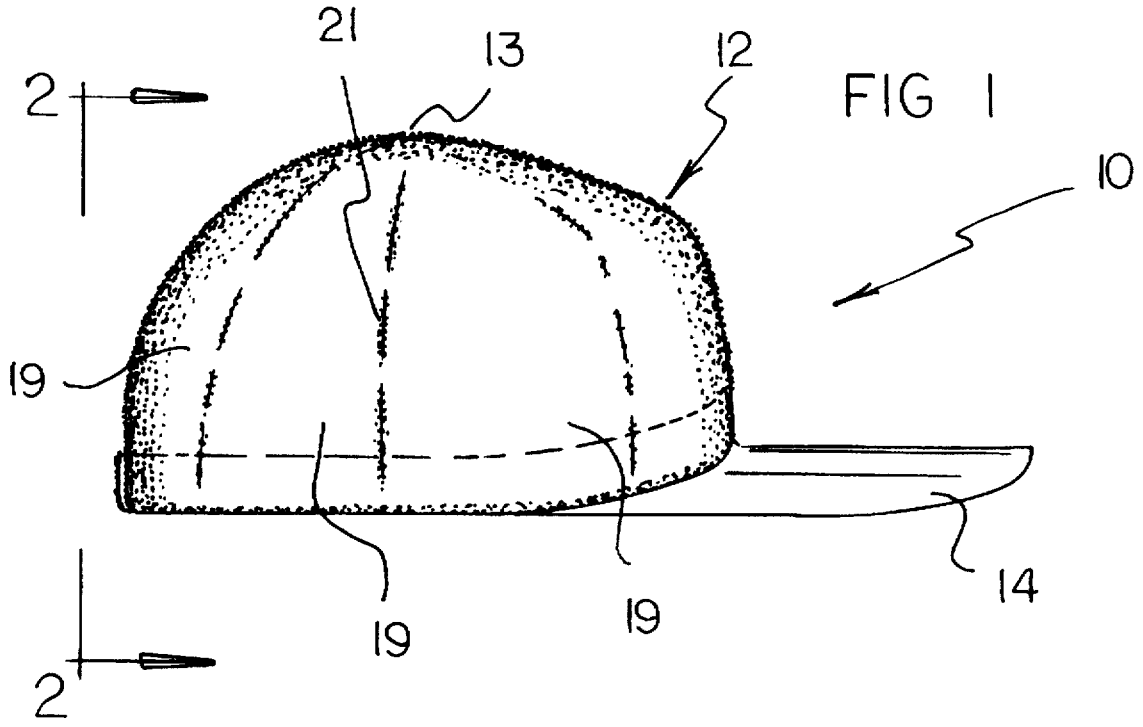
FIG. 1 is a perspective view showing a first embodiment of the head covering of the invention.
Figure 2:
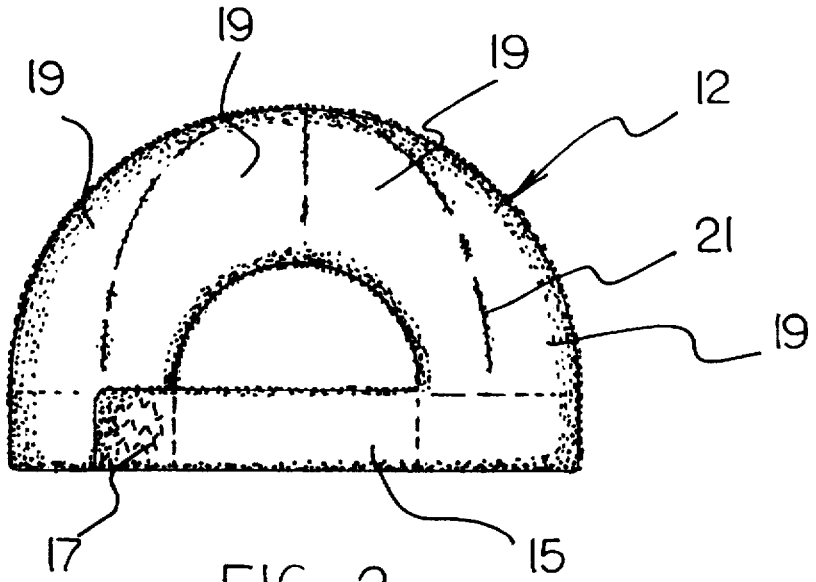
FIG. 2 is a rear view of the embodiment of the head covering shown in FIG. 1 taken along line 2—2 of FIG. 1.

Turning to FIGS. 1 and 2, a first embodiment of the head covering 10 includes a cap-like assembly 12 made from soft, water absorbent fabric. The soft, water absorbent fabric is characterized by having loops 13. The soft, water absorbent fabric may be comprised of terry cloth. The terry cloth fabric may be comprised of plural terry cloth panels 19 sewn together by stitches 21. A visor 14 is connected to the cap-like assembly 12. The cap-like assembly 12 includes a head-size adjustment strap 15 located in a back portion of the cap-like assembly 12. The head-size adjustment strap 15 includes a portion of hook-containing material 17 that attaches to the cap-like assembly 12 for securing a selected head-size adjustment. The hook-containing material 17 can be comprised of VELCRO(™) material.

The first embodiment of the head covering 10 can be used in a number of ways. In one way, the cap-like assembly 12 can be wetted with water and then placed on a person's head. When the water in the wetted cap-like assembly 12 evaporates, the evaporating water takes heat away from the person's head. In this way, the evaporating water serves to cool the person's head.

Another way of using the head covering 10 is to use it as one would use a towel. In this mode of use, the cap-like assembly 12 is used in a dry condition until used as a towel. For example, if a person's face and arms are perspiring, the person can remove the head covering 10 from one's head and use the cap-like assembly 12 to wipe or blot the perspiration.

Turning to FIGS. 3 and 4, a second embodiment of the invention is shown. Reference numerals are shown that correspond to like reference numerals that designate like elements shown in the other figures. In addition, the cap-like assembly 12 serves as an inner cap-like assembly, and an inner visor 20 is connected to the inner cap-like assembly 12. An inner connector assembly 22 is connected to a top side of the inner visor 20. An outer cap-like assembly 24. An outer visor 26 is connected to the outer cap-like assembly 24. An outer connector assembly 28 is connected to a bottom side of the outer visor 26. The inner connector assembly 22 and the outer connector assembly 28 are placed in registration when the outer cap-like assembly 24 covers the inner cap-like assembly 12 and when the outer visor 26 covers the inner visor 20.

The inner connector assembly 22 and the outer connector assembly 28 are complementary snap connectors. The inner connector assembly 22 and the outer connector assembly 28 can also be complementary hook-and-loop connectors such as VELCRO(™) material. The outer visor 26 is longer than the inner visor 20. The outer cap-like assembly 24 is larger than the inner cap-like assembly 12.

The second embodiment of the head covering 10 of the invention can be used in ways similar to the first embodiment. In addition, the outer cap-like assembly 24 can cover the inner cap-like assembly 12 to protect the inner cap-like assembly 12, and the outer visor 26 can cover the inner visor 20 to protect the inner visor 20. In this mode of use, the inner cap-like assembly 12 can be either maintained dry or wetted as described above. In this mode of use, the inner cap-like assembly 12 can be regarded as a liner for the outer cap-like assembly 24.

In another mode of use, the outer cap-like assembly 24 and the outer visor 26 can be removed from the inner cap-like assembly 12 and the inner visor 20 leaving the inner cap-like assembly 12 and the inner visor 20 exposed to the sun. In this mode of use, the second embodiment of the invention can be used in ways similar to the first embodiment of the invention.

In yet another mode of using the second embodiment of the invention, the inner cap-like assembly 12 and the inner visor 20 can be removed from the outer cap-like assembly 24 and the outer visor 26. Then, the outer cap-like assembly 24 can be used to cover a person's head directly, and the outer visor 26 can be used to shield the person's eyes. In a sense, with this mode of use, the outer cap-like assembly 24 and the outer visor 26 are used substantially as a conventional visor-containing cap.

The components of the head covering of the invention can be made from inexpensive and fabric and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved head covering that is low in cost, relatively simple in design and operation, and which advantageously has a cooling medium, other than ambient air, to aid in cooling a person's head. With the invention, a head covering is provided which can remain on a person's head and still employ the cooling properties of water. With the invention, a head covering employs water absorbent materials that are found in a head band. With the invention, a head covering is provided which can be washed in an aqueous medium in a washing machine without destroying important properties of the head covering. With the invention, a head covering is provided which can serve as a water absorbent towel for blotting or wiping perspiration. With the invention, a head covering is provided which employs terry cloth as a material for the head covering. With the invention, a head covering is comprised of a soft, water absorbent fabric characterized by having loops. With the invention, a head covering is comprised of a soft, water absorbent fabric.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A head covering, comprising:

an inner cap-like assembly made from soft, water absorbent fabric;

an inner visor connected to said inner cap-like assembly, an inner connector assembly connected to a top side of said inner visor, an outer cap-like assembly, an outer visor connected to said outer cap-like assembly, and an outer connector assembly connected to a bottom side of said outer visor, wherein said inner connector assembly and said outer connector assembly are placed in registration when said outer cap-like assembly covers said inner cap-like assembly and when said outer visor covers said inner visor.

2. The head covering of claim 1 wherein said soft, water absorbent fabric is characterized by having loops.

3. The head covering of claim 2 wherein said soft, water absorbent fabric is comprised of terry cloth.

4. The head covering of claim 3 wherein said terry cloth fabric is comprised of plural terry cloth panels sewn together by stitches.

5. The head covering of claim 1 wherein said inner cap-like assembly includes a head-size adjustment strap located in a back portion of said inner cap-like assembly.

6. The head covering of claim 5 wherein said head-size adjustment strap includes a portion of hook-containing material that attaches to said inner cap-like assembly for securing a selected head-size adjustment.

7. The head covering of claim 1 wherein said inner connector assembly and said outer connector assembly are complementary snap connectors.

8. The head covering of claim 1 wherein said outer visor is longer than said inner visor.

9. The head covering of claim 1 wherein said outer cap-like assembly is larger than said inner cap-like assembly.

* * * * *